US008610625B2

(12) United States Patent
Le Grange et al.

(10) Patent No.: US 8,610,625 B2
(45) Date of Patent: Dec. 17, 2013

(54) METHOD AND APPARATUS FOR TRANSMITTING AND RECEIVING PHASE-CONTROLLED RADIOFREQUENCY SIGNALS

(75) Inventors: Jane D. Le Grange, Princeton, NJ (US); Alex Pidwerbetsky, Randolph, NJ (US)

(73) Assignee: LGS Innovations LLC, Florham Park, NJ (US)

( * ) Notice: Subject to any disclaimer, the term of this patent is extended or adjusted under 35 U.S.C. 154(b) by 196 days.

(21) Appl. No.: 12/975,485

(22) Filed: Dec. 22, 2010

(65) Prior Publication Data

US 2012/0162011 A1 Jun. 28, 2012

(51) Int. Cl.
*H01Q 3/22* (2006.01)
*H01Q 3/00* (2006.01)

(52) U.S. Cl.
USPC ..... 342/375; 342/373

(58) Field of Classification Search
USPC ..... 342/357.27, 457.465, 368, 372–375; 385/15, 16, 18; 359/331
See application file for complete search history.

(56) References Cited

U.S. PATENT DOCUMENTS

| | | | | |
|---|---|---|---|---|
| 5,761,351 | A * | 6/1998 | Johnson | 385/15 |
| 6,356,377 | B1 | 3/2002 | Bishop et al. | 359/290 |
| 6,426,721 | B1 * | 7/2002 | Obara | 342/375 |
| 7,084,811 | B1 * | 8/2006 | Yap | 342/375 |
| 2009/0129780 | A1 | 5/2009 | Bernasconi et al. | 398/79 |

OTHER PUBLICATIONS

J.D. Le Grange et al, Demonstration of a time buffer for an all-optical packet router, Journal of Optical Networking vol. 6 No. 8 (Aug. 2007) pp. 975-982.

C.R. Doerr, "Planar Lightwave Devices for WDM", Optical Fiber Telecommunications, vol. IVA, ed. By I Kaminow and T. Li (Academic Press, New York 2002), pp. 405-476.

* cited by examiner

*Primary Examiner* — Dao Phan
(74) *Attorney, Agent, or Firm* — M. I. Finston; N. Desai

(57) ABSTRACT

A method of beamforming a radiofrequency array having multiple antenna elements is provided. The method includes transmitting two or more sub-beams of a modulated light beam through a switched fabric, using wavelength switching to designate a respective path through the switched fabric for each sub-beam, and converting each sub-beam to a driving signal for one or more of the antenna elements or to a received signal from one or more of the antenna elements. Each path through the switched fabric has a selected cumulative true time delay.

9 Claims, 4 Drawing Sheets

METHOD AND APPARATUS FOR TRANSMITTING AND RECEIVING PHASE-CONTROLLED RADIOFREQUENCY SIGNALS

FIELD OF INVENTION

This invention relates to phase control in radiofrequency transmission and reception using arrayed antenna elements.

ART BACKGROUND

It has long been known that arrays of multiple antennas for radar and other radiofrequency transmission and reception offer certain advantages over single-element antennas, such as enhanced spatial selectivity, signal gain, and beam steerability. These and other advantages are greatest when there is precise control over the phases of the antenna elements; i.e., over the relative phase of the wavefront leaving each transmissive element, or of the relative phase, at the detector, of the signal collected by each receptive element.

Conventional methods of phase control include electronic methods based on the transfer function of a reactive circuit, and delay-based methods that use variable-length delay lines to adjust the phase of each radiofrequency (RF) feed to an antenna element. Neither of these approaches is perfectly adapted for all applications. For example, one drawback of electronic methods is that they are limited in bandwidth. One drawback of delay-based methods is that precise, tuneable phase control is difficult to implement.

Accordingly, there remains a need for techniques of phase control that combine high precision with high bandwidth.

SUMMARY OF THE INVENTION

We have developed a technique based on optical delay that can provide both high precision and high bandwidth.

In an embodiment adapted for transmission, a light beam is modulated with an RF signal. The light beam is divided into a plurality of beamlets and distributed through an optical network to an array of transmission elements. At each transmission element, at least one beamlet is converted to an RF signal and transmitted.

The optical network includes wavelength-selective elements coupled to optical delay lines. The optical network uses wavelength based routing to deliver each beamlet through a designated amount of delay to a designated transmission element.

In an embodiment adapted for reception, an incoming radiofrequency signal is converted to an electric signal at each of a plurality of reception elements. At each reception element, an optical beamlet is modulated with the electric signal. The respective beamlets are combined into a composite optical signal as a result of propagating them through an optical network of the kind described above. The composite optical signal is detected and further processed, for example by demodulation. While propagating through the optical network, the beamlets are subjected to wavelength based routing to deliver each beamlet through a designated amount of delay before it is combined into the composite optical signal.

An embodiment of the invention comprises an optical network of the kind described above, as adapted for transmission, reception, or both transmission and reception.

DETAILED DESCRIPTION

A type of optical network useful for the practice of the invention is a network in which passive wavelength-selective optical delay (WSOD) devices are combined with wavelength-shifting devices to provide wavelength-switched optical delay. Such wavelength-switched optical delay networks are known. One example is described in J. D. LeGrange et al., "Demonstration of a time buffer for an all-optical packet router," *J. Opt. Networking*, vol. 6, no. 8 (August 2007) 975-982 (LeGrange 2007).

Figure 1:
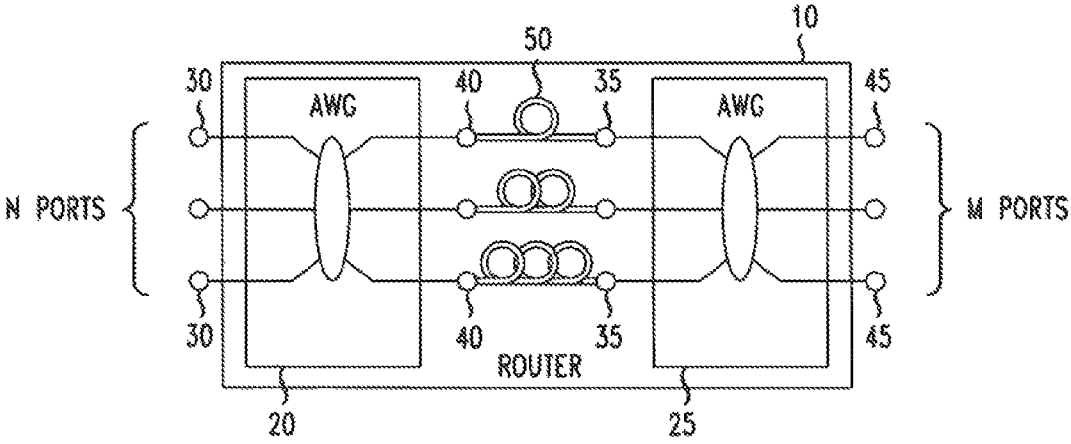
FIG. 1 (PRIOR ART)
FIG. 1 is a schematic diagram of a wavelength-selective optical delay device of the prior art.

With reference to FIG. 1 one example of a WSOD device 10 as described, e.g., in LeGrange 2007 is a wavelength division multiplexing (WDM) device having a total of N input ports and M output ports. (As will be seen, it will often be advantageous for the port arrangement to be symmetrical, such that N=M.) For purposes of illustration, a total of three input ports and three output ports is shown in the figure. These numbers should not be taken as limiting. Values for N and M of 100 or even more are well within current technical capability.

WDM device 10 includes an arrayed waveguide grating (AWG) 20 on the input side, and an arrayed waveguide grating 25 on the output side. Each AWG has a number N' of input ports 30, 35 and a number M' of output ports 40, 45. (In the view of FIG. 1, the input ports of AWG 20 are shown as identical to the input ports of device 10, and the output ports of AWG 25 are shown as identical to the output ports of device 10. This is by way of illustration and is not meant to exclude other possible arrangements.)

Although not essential, it will often be advantageous for gratings 20 and 25 to be symmetrically arranged, such that the number of input ports of AWG 20 is matched to the number of output ports of AWG 25, and likewise that the number of output ports of AWG 20 is matched to the number of input ports of AWG 25. In the discussion below, we will assume the same number N of ports for the input and output sides of both AWG 20 and AWG 25. Accordingly, FIG. 1 shows N=3 input and output ports for each of AWGs 20 and 25. As explained above, this choice for N is illustrative only, and not intended to be limiting.

As those skilled in the art will understand, an AWG functions as a two dimensional diffraction grating. As such, it can convert spectral routing to spatial routing. A typical AWG is made from two interconnected star couplers. The connection between the star couplers is made by an array of waveguides having linearly increasing lengths.

Due to the diffractive behavior of the arrayed waveguides, a suitable optical input will result in light emerging from each waveguide at a particular wavelength. The wavelengths are determined by the lengths of the respective waveguides, in accordance with the laws of optical interference. The length increments between waveguides are typically set to provide a phase shift of $2\pi A$ radians from each waveguide to the next, where A is the diffractive order of the grating.

More particularly, an input signal applied to a given input port will be mapped to different output ports with respective shifts of wavelength. Accordingly, a signal having a given wavelength can enter the AWG on any input port and be routed to a unique output port determined by the given wavelength and by the identity of the input port.

Known designs for the star couplers and waveguide grating enable the AWG to be used as a spectral multiplexer or demultiplexer with minimal crosstalk between channels. The AWG may be used over multiple grating orders, thereby extending the usable wavelength range and making it possible to form multiple beams simultaneously. One source of further information on the AWG is C. R. Doerr, "Planar Lightwave Devices for WDM" in *Optical Fiber Telecommunications*, volume IVA, edited by Ivan Katninow and Tingye Li, (Academic Press, New York, 2002), pp 405-476.

Turning back to FIG. 1, it will be seen that each of output ports 40 of AWG 20 is coupled to a corresponding one of input ports 35 of AWG 25. (It should be noted that although the figure shows all of the available ports being used in this manner, it is also possible to select only some of the available ports for such use.) Although not essential, it will often be advantageous for each of output ports 40 to be coupled to the like-numbered one of input ports 35, as illustrated in FIG. 1. The reason is that if the AWGs are coupled in an arrangement with mirror symmetry, then (for a given operating wavelength) light that is injected at a particular input port 30 will exit from the like-numbered output port 45.

Each coupling between an output port 40 and an input port 35 is made through a respective optical delay element 50. Typically, each of the optical delay elements 50 will provide a different amount of delay.

In view of the foregoing, it will be understood that an AWG arrangement such as that shown in FIG. 1 provides wavelength-selectable delay. That is, an optical signal injected at a particular one of input ports 30 (of AWG 20) will exit at the corresponding output port 45 (of AWG 25), irrespective of the input wavelength. However, the input wavelength will determine the output port 40 of AWG 20 to which the signal is mapped. This, in turn, will determine which of the delay elements 50 is used to couple the signal from AWG 20 to AWG 25.

It should be noted that if the mapping between input and output ports of each of the AWGs is different for each operating wavelength, then it may be possible to apply input signals simultaneously to all of the input ports 30 without collision. That is, two signals applied to different input ports 30 will be mapped to the same output port 40 only if they are on different operating wavelengths. If they are on different operating wavelengths, they will not affect each other. Similarly, two input signals can be applied to the same input port 30 without colliding if they are on different operating wavelengths. (Although the AWG is described here with linearly incrementing phase and therefore wavelength shifts from channel to channel, it should be noted that in other embodiments, any router design that results in wavelength selection of the output port could be used.)

Figure 2:
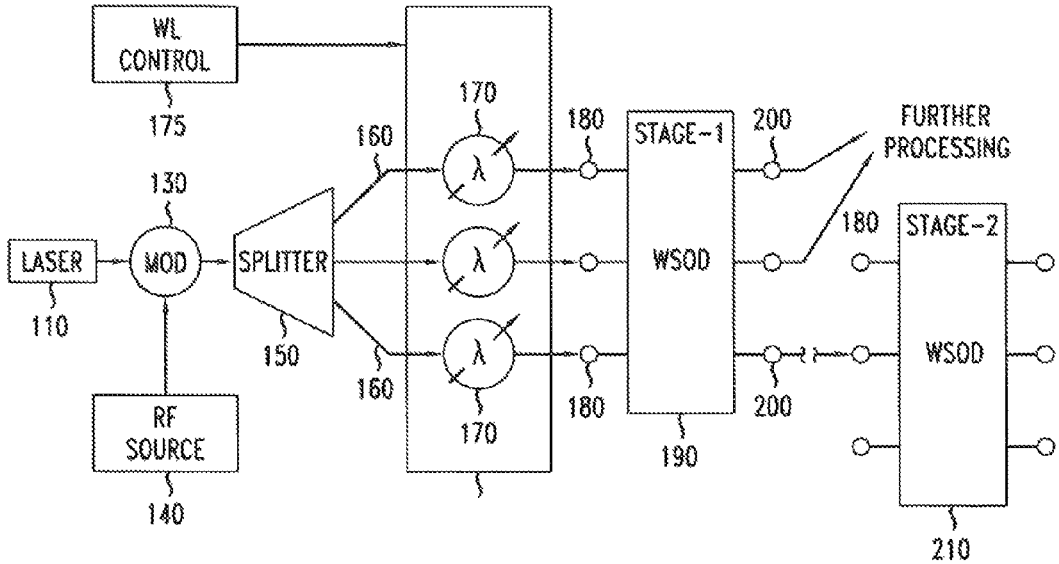
FIG. 2 is a schematic diagram of a wavelength-switched optical delay network according to an embodiment of the invention.

Turning now to FIG. 2, an example of a wavelength-switched optical delay network includes a master oscillator 110, which is typically a laser oscillator. The master oscillator produces light beam 120, which is modulated in modulator 130 with the RF signal from RF source 140. The modulated light beam is split by splitter 150 into a plurality of beamlets 160. Each of the beamlets is subjected to a wavelength shifter 170, controlled by control unit 175, which places the beamlet on one of the operating wavelengths. The beamlet is then applied as input to a respective one of input ports 180 of WSOD device 190, which may, e.g., be similar to device 20 of FIG. 1. As explained above, the light applied to each of input ports 180 will emerge at a corresponding one of output ports 200; having in the meantime been subjected to a discrete amount of delay determined by the applicable input port and operating wavelength.

The light emerging from each of output ports 200 may be extracted from the optical delay network for further processing and utilization as will be described below, or it may be directed to a next stage of the optical delay network, where it is again split in an optical splitter (not shown), and each output from the splitter is subjected to a further wavelength shifter (not shown) and injected at an input port of a further WSOD device, such as device 210 of the figure.

Figure 3:
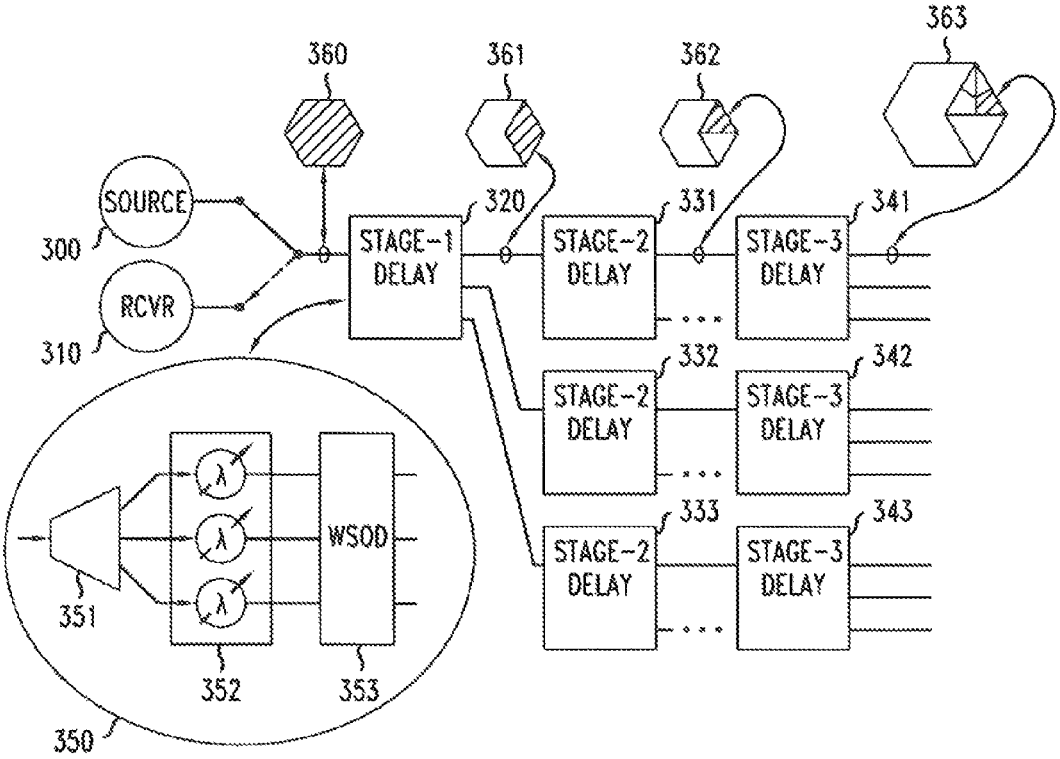
FIG. 3 is a schematic diagram of an optical delay network having three stages, according to an embodiment of the invention.

FIG. 3, for example, shows an optical delay network having three stages. If the network is operated in transmission, source 300 injects a radiofrequency modulated optical beam into the first stage. If the network is operated in reception, a composite optical signal (described in more detail below) is extracted from the first stage and directed to receiver 310 for, e.g., detection which converts the signal to the electrical domain, followed by demodulation and further processing. The network as shown in the figure is switchable between transmission and reception modes. In other implementations, the network may be dedicated to one mode or the other.

Each stage of the network of FIG. 3 consists of one or more sub-networks. As shown, the first stage has one sub-network 320, and the second and third stages each have three subnetworks, respectively 331, 332, 333, and 341, 342, 343. These numbers of subnetworks have been chosen solely for purposes of illustration and should not be understood as limiting.

As shown in inset 350, each sub-network includes an optical splitter 351, a set of wavelength-shifters 352 subject to a control unit (not shown), and a WSOD device 353.

Figure 4:
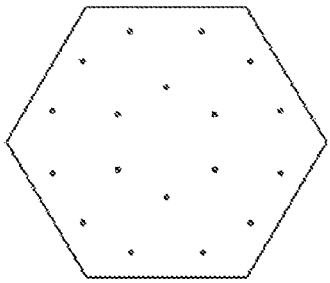
FIG. 4 is a schematic drawing of a hypothetical array having eighteen antenna elements.

In the design of antenna arrays, it is often advantageous to organize an array having many elements into a plurality of sub-apertures that are organized hierarchically, so that a sub-aperture at a higher level of organization includes a plurality of sub-apertures at a lower level of organization. Advantageously, each of the sub-networks at each stage of the network is associated with a respective sub-aperture of the array. To illustrate this concept, FIG. 4 provides a schematic drawing of a hypothetical array having eighteen antenna elements. With reference to insets 360-363 of FIG. 3, the overall array (inset 360) may be subdivided into three sub-apertures, each containing six elements, as shown in inset 361. Each of these may be further subdivided into two sub-apertures, each containing three elements, as shown in inset 362. Each of these may be further subdivided into three sub-apertures, each containing a single element, as shown in inset 363. These subdivisions are purely illustrative and not meant to be limiting.

Turning again to FIG. 3, it will now be understood that each stage illustrated in FIG. 3 corresponds to one level in the hierarchical division of overall aperture 360 into sub-apertures, and each of the subnetworks shown in the figure corresponds to a respective sub-aperture. Accordingly, stage 1 provides a respective coarse amount of delay to each of the first-level sub-apertures, one of which is shown as shaded in inset 361. For each of the first-level sub-apertures, stage 2 adds a respective finer amount of delay to each of the second-level sub-apertures, one of which is shown as shaded in inset 362. For each of the second-level sub-apertures, stage 3 adds a respective still finer amount of delay to each of the third-level sub-apertures. A similar architecture is readily extended to further levels and can be used to provide controllable delay to large arrays of antenna elements, numbering in the hundreds or even in the thousands.

As noted earlier, two optical signals can enter or exit the same ports of a WSOD device without colliding if they are in different wavelength channels. As a consequence, it may be possible in some implementations to use the optical delay network, or a portion of it, for delay processing of two or more simultaneous signals carrying independent information, if the respective signals are placed on mutually orthogonal sets of operating wavelengths.

For example, those skilled in the art will appreciate that one of the features of an AWG device is the free spectral range (FSR), having the property that if signals of two wavelengths separated by the FSR are applied to the same input port of an AWG demultiplexer, they will be directed to the same output port. Thus, the FSR defines a (weakly wavelength-dependent) periodic band structure for the responsive behavior of an AWG device. Mutually orthogonal sets of operating wavelengths can be selected on the basis of this band structure.

Similarly, it may be possible to use the same WSOD device to simultaneously perform the delay processing of an optical signal for two different sub-apertures, if the sets of operating wavelengths corresponding to the respective sub-apertures are chosen appropriately. This may be advantageous if, for example, the various sub-apertures differ only in their corresponding coarse amounts of delay, but add to the coarse delay the same increments of fine delay. Thus, the total amount of hardware could be reduced by reusing one or more of the WSOD devices that provide fine delay.

It should be noted that if one or more WSOD devices are reused for multiple independent signals or for multiple sub-apertures (at the same level), it will generally be necessary to include one or more wavelength demultiplexers in the network for separating the respective mutually orthogonal sets of operating wavelengths after the last reused device.

As noted above, the spatial selectivity and beam steerability achievable using arrays of multiple antennas are highly advantageous for radar, communications, and other radiofrequency applications. The signal processing that underlies these capabilities of antenna arrays is beamforming, i.e., the coherent combination of the signals going to or from the respective antenna elements.

Beamforming is typically achieved using electronic phase shifters, which are well known. However, the performance of electronic phase shifters is frequency-dependent. For that reason, beamforming is disadvantageously limited in bandwidth when it is performed solely by using electronic phase shifters.

In accordance with the invention, a wavelength-switched optical network such as that described above is used to provide true time delay for at least part of the beamforming. That is, the timing of the phase fronts propagating from individual antenna elements during operation in the transmission mode, or the effective (from the viewpoint of the receiver) timing of the phase fronts propagating toward the individual antenna elements during operation in reception mode, is controlled by optical delay in the signals that the optical delay network directs to or from the antenna elements. Because the optical delays are not affected by the frequencies used for radiofrequency modulation, bandwidths can be achieved that are much greater than those achievable using only electronic phase shifters.

We believe that because of the precise tolerances achievable in the fabrication of optical delay elements, true time delay can be used to provide controllable delay increments over an extremely wide dynamic range, extending from microseconds or more, down to 0.01 ns or even less. In typical switched fabrics of the kind described here, true time delay provided via optical delay elements will be most useful in the range from 0.1 ns to 100 ns. For the finest phase control at the last stage of the network (i.e., at the stage nearest the antenna elements), we believe it will be most advantageous to use electronic phase shifters. (It should be noted in this regard that the performance of electronic phase shifters is limited by the product of bandwidth times interelement separation. Thus, the electronic phase shifters are most advantageous at the finest level of delay processing, where the corresponding antenna elements are typically clustered within a small spatial volume.)

Figure 5:
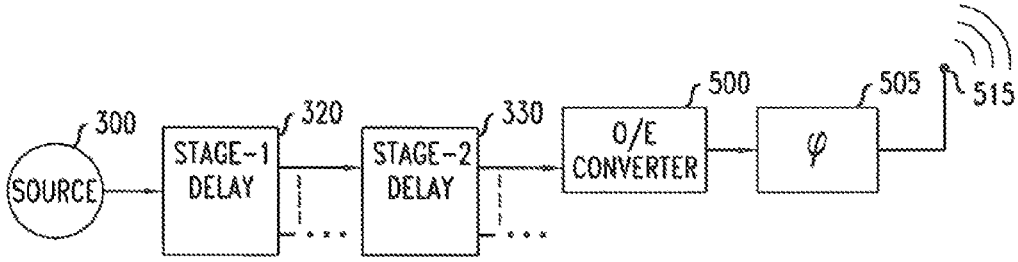
FIG. 5 is a partial schematic drawing of a beamforming radiofrequency device including a delay network that includes two stages of frequency-switched optical delay and one stage of electronic phase shifting, operative in transmission.

For example, FIG. 5 shows a portion of a beamforming radiofrequency device, including a delay network that includes two stages of frequency-switched optical delay and one stage of electronic phase shifting. Elements common with FIG. 3 are indicated using like reference numerals. The device is operating in transmission mode.

As seen in the figure, the coarser two stages of delay processing are done in the optical domain by subnetworks 320 and 330. However, the finest stage of delay processing, in which the delay increments are mapped to individual antenna elements, is performed in the electrical domain. Accordingly, each output from stage-2 delay subnetwork 330 is directed to an optical-to-electronic (O/E) converter 500. Devices for performing O/E conversion using high-speed photodiodes, for example, are well known and need not be described here in detail. (Herein, devices for optical-to-electronic conversion as well as devices for electronic-to-optical conversion will be collectively referred to as "optoelectronic devices".)

The electrical output from O/E converter 500 is directed to electronic phase-shifting device 505. Electronic phase shifters are well known and need not be described here in detail.

The output from phase shifter 505 is directed to radiative antenna element 515, from which it is transmitted as electromagnetic radiation. The signal path from O/E converter 500 to radiative element 515 will typically include one or more electronic amplifiers, which have been omitted to simplify the drawing.

Figure 6:
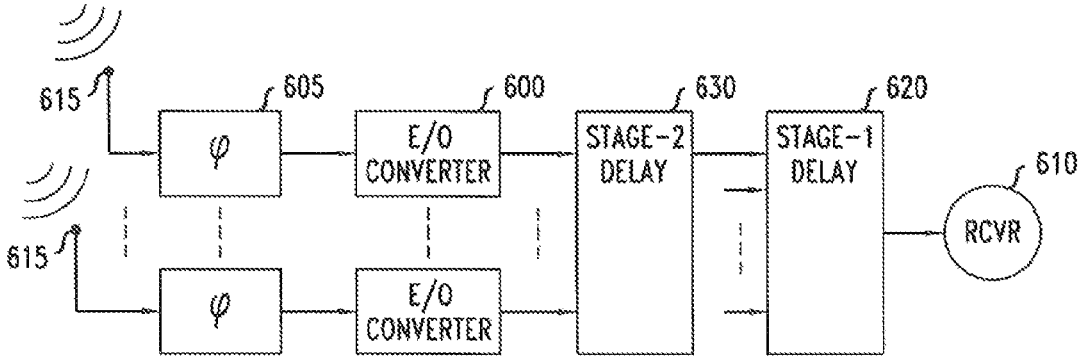
FIG. 6 is partial schematic drawing of a beamforming radiofrequency device similar to that of FIG. 5, but operative in reception.

FIG. 6 shows an arrangement similar to that of FIG. 5, but operating in reception mode. A plurality of antenna elements having radiofrequency absorbers (which may of course also function as radiators) 605 are grouped into a sub-aperture by stage-2 delay network 630. The output of each absorber 605 is directed to a respective electronic phase shifter, where it receives a line increment of phase adjustment (which is equivalent to a fine increment of delay). The output of each phase shifter is directed to a respective electronic-to-optical (E/O) converter 600. The outputs of the electronic-to-optical (E/O) converters 600 are directed to stage-2 delay sub-network 630, where they each receive a coarser increment of delay. The signal path between absorber 615 and sub-network 630 will typically include one or more electronic amplifiers, which have been omitted to simplify the drawing.

In sub-network 630, after each input signal (i.e., each signal corresponding to one of the individual absorbers 615) has been subjected to optical delay processing, it is shifted onto a common operating wavelength for output from sub-network 630. Accordingly, the output from sub-network 630 is a composite output signal on one operating wavelength. (As noted above, parallel operation is possible in two or more sets of mutually orthogonal operating wavelengths.)

In a like manner, the outputs from a plurality of stage-2 delay networks 630 are collected by stage-1 delay sub-network 620, subjected to still coarser increments of delay, shifted onto a common operating wavelength, and combined into a composite optical signal. The composite optical signal output from stage-1 delay network 620 is directed to receiver 610 for detection and demodulation or other further processing.

By way of example, the WSOD devices in a network having two stages of optical delay might each include 100 waveguides of various lengths to serve as the delay elements. Thus, for example, the coarse WSOD might have waveguides which span 100 ns of delay in 1 ns increments, and the fine WSOD might have waveguides which span 1 ns of delay in increments of 0.01 ns. As noted, electronic phase shifters may be used to provide still liner increments of delay.

With further reference to FIGS. 5 and 6. O/E conversion. e.g. in converter 500 and receiver 610, is readily carried out using well-known optoelectronic devices such as high-speed photodiodes. Conversely, E/O conversion, e.g. in converters 600, may be carried out by well-known techniques such as using a lithium niobate modulator or an electroabsorption modulator to modulate an optical carrier provided by a low-power continuous wave laser.

The optical signal source, such as source 300, advantageously uses a modulated high-power laser, or alternatively a modulated low-power laser whose output is subjected to optical amplification.

The wavelength-shifting devices may use any of various well-known technologies. One example is provided by a silicon optical amplifier (SOA) wavelength converter. A second example is provided by an electroabsorption modulator (EAM) device.

The EAM device can be used as a wavelength converter by converting the optical data signal to an RF signal via a high speed photodiode. The electrical output of the photodiode is amplified by RF amplifiers and then applied to the EAM. The data modulation is then applied to CW light from a tunable laser transmitted through the EAM, thereby transferring the data modulation to the wavelength of the CW light.

What is claimed is:

1. A method of beamforming a radiofrequency (RF) array having multiple antenna elements, comprising:

(a) transmitting two or more sub-beams split from a modulated light beam having a first wavelength through a switched fabric, the switched fabric including a wavelength shifter configured for shifting at least one of the two or more sub-beams from the first wavelength to a second wavelength;

(b) using wavelength switching to designate a respective path through the switched fabric for each sub-beam, wherein each path has a selected cumulative true time delay; and (c) converting each sub-beam to provide a respective driving signal for each of one or more of the antenna elements or converting the modulated light beam to provide a received signal from one or more of the antenna elements.

2. The method of claim 1, wherein:

the respective path for each sub-beam passes through at least two stages of delay elements; and each said stage provides phase adjustment at a respective level of precision by subjecting the sub-beam to a selected amount of true time delay.

3. The method of claim 2, further comprising adjusting the phase of the RF signal modulated onto each sub-beam at a highest level of precision by electronic phase-shifting of the RF signal.

4. The method of claim 1, further comprising:

modulating an RF signal onto a light beam, thereby to produce said modulated light beam;

and splitting the modulated light beam into two or more sub-beams before the step of transmitting the sub-beams through the switched fabric; and wherein the converting step is carried out to provide respective driving signals for one or more of the antenna elements.

5. The method of claim 1, wherein:

each sub-beam to be transmitted through the switched fabric is modulated with an RF signal detected by an antenna element of an antenna array;

the modulated light beam is a composite beam in which the respective sub-beams are combined after passing through the switched fabric; and the modulated light beam is converted to provide a received signal from one or more of the antenna elements.

6. Apparatus, comprising:

(a) a radiofrequency antenna array having multiple antenna elements;

(b) an optoelectronic device connected to each of the antenna elements, wherein each said optoelectronic device is configured to obtain an RF signal for driving its respective antenna element by converting a modulated optical sub-beam, or is configured to modulate, onto an optical sub-beam, an RF signal detected by its respective antenna element;

(c) an optical switched fabric having a set of input or output ports arranged to accept light from the respective optoelectronic devices or to deliver light to the respective optoelectronic devices;

(d) an optical switching controller; and (e) a source of RF-modulated laser light for injection into the switched fabric or a detector configured to receive modulated light from the switched fabric and convert it to provide an RF signal; wherein:

(f) the switched fabric comprises a plurality of passive optical true time delay elements, a plurality of wavelength-selective routing elements, and a plurality of wavelength shifters;

(g) the wavelength shifters are connected to the optical switching controller;

(h) the wavelength shifters are configured to shift at least one of a plurality of sub-beams from a first wavelength to a second wavelength, and are configurable, by said controller, to define a respective path through the switched fabric for each of the plurality of sub-beams, wherein each path is directed by the routing elements through one or more time delay elements to provide a selected cumulative true time delay; and (i) the switched fabric is operable to deliver the RF-modulated laser light having the first wavelength to the respective optoelectronic devices by splitting the RF-modulated laser light having the first wavelength into respective sub-beams, or to deliver respective sub-beams from the optoelectronic devices to the detector as a composite light beam.

7. The apparatus of claim 6, wherein:

the switched fabric is configured such that there are at least two successive stages of parallel delay elements;

each sub-beam is directable, in sequence, through one delay element of a first stage and through one delay element of at least one further delay stage; and each delay stage provides true time delay at a different level of precision.

8. The apparatus of claim 6, further comprising an electronic phase shifter connected to each optoelectronic device and configured to adjust the phase of the RF signal obtained from or delivered to the connected optoelectronic device.

9. The apparatus of claim 7, wherein each delay stage comprises at least one subnetwork, and each subnetwork comprises:

a first and a second arrayed waveguide grating (AWG) for wavelength-selective routing between a plurality of input ports and a plurality of output ports of each said AWG; and a plurality of passive optical delay elements arrayed in parallel between said AWGs such that each said delay element is optically connected from an output port of the first AWG to an input port of the second AWG.

* * * * *